United States Patent [19]

Goodin et al.

[11] Patent Number: 4,493,755

[45] Date of Patent: Jan. 15, 1985

[54] ELECTROLYTIC PREPARATION OF ORTHOALKYL-2-HALO-N-ACYLANILIDES

[75] Inventors: Richard D. Goodin, St. Louis; John P. Chupp, Kirkwood, both of Mo.

[73] Assignee: Monsanto Company, St. Louis, Mo.

[21] Appl. No.: 530,135

[22] Filed: Sep. 7, 1983

[51] Int. Cl.[3] ..... C25B 3/00

[52] U.S. Cl. ..... 204/73 R; 204/59 R; 204/72

[58] Field of Search ..... 204/59 R, 72, 73 R

[56] References Cited

U.S. PATENT DOCUMENTS

| | | | |
|---|---|---|---|
| 3,480,525 | 11/1969 | Wessling et al. | 204/59 |
| 3,480,527 | 11/1969 | Wessling et al. | 204/59 |
| 3,616,314 | 10/1971 | Settineri et al. | 204/59 |
| 3,660,257 | 5/1972 | Settineri et al. | 204/72 |
| 4,172,095 | 10/1979 | Steinman et al. | 260/578 |
| 4,209,464 | 6/1980 | Steinman et al. | 260/578 |
| 4,404,069 | 9/1983 | Goodin et al. | 204/59 |

OTHER PUBLICATIONS

Shono et al, Tetrahedron Letters, vol. 29, pp. 817–821.

The Chemistry of the Sulphonium Group, (copyright 1981, John Wiley; edited by C. J. M. Sterling et al), Chapter 7, Electrochemistry of the Sulphonium Group, J. Grinshaw, pp. 141–155.

Chambers et al., J. Electronal. Chem., vol. 87, (1978), pp. 235–250.

*Primary Examiner*—John F. Niebling

*Attorney, Agent, or Firm*—Joseph D. Kennedy; James W. Williams, Jr.

[57] ABSTRACT orthoAlkyl-orthotrifluoromethyl-2-chloroacetanilides and related compounds are prepared by electrolytic reduction with sulfide cleavage of benzylsulfonium salts with requisite chloroacetylamino and trifluoromethyl substituents on the benzyl group. The compounds are useful as intermediates for conversion to herbicidal compounds.

21 Claims, No Drawings

ELECTROLYTIC PREPARATION OF ORTHOALKYL-2-HALO-N-ACYLANILIDES

This invention relates to preparation of orthoalkyl-N-acylanilides by electrolytic desulfurization of [ortho-(N-acylamino)phenylalkyl]sulfonium salts and in particular to preparation of orthoalkyl 2-haloacetanilides by such process. The invention also concerns novel [ortho-(N-acylamino)phenylalkyl]sulfonium salts.

BACKGROUND OF THE INVENTION

The present invention involves use of electrolytic desulfurization procedures to prepare orthoalkyl acetanilides. Various chloro-acetanilides, including those with orthoalkyl and perfluoroalkyl substituents, are known to be useful as herbicides or intermediates therefor. The present invention is concerned with preparation of particular types of compounds which are particularly useful and valuable as intermediates in preparation of herbicides, as further described herein with reference to patents of others, and to commonly assigned patent applications of one or more of the present applicants or their associates. Similarly, the sources of reactants are described with reference to published patents and commonly assigned applications. A number of publications have concerned the electrolytic cleavage of sulfide, sulfoxide or sulfone compounds. See L. Horner and N. Neuman, *Chem. Ber,* 1975, 98 1715; and various other publications cited in commonly assigned copending application of the present applicants and others, Ser. No. 358,771, filed Mar. 17, 1982 U.S. Pat. No. 4,404,069. The stated copending application concerns electrolytic desulfurization of the requisite sulfide, sulfoxide or sulfone compounds to prepare compounds such as 2-methyl-6-trifluorothylaniline. Electrolytic processes for reduction of some described sulfonium compounds are known such as in U.S. Pat. No. 3,660,257 which describes processes at a mercury cathode for converting -methylbenzyl sulfonium salts to -methylbenzyl dimers, with very negative cathode settings and low reduction rates favoring formation of ethylbenzene at the expense of the dimers. Other publications describe electrolytic reductions of sulfonium salts producing sulfides and a radical R· which can take part in various further reactions. However, such prior published materials are not concerned with reactions of the sulfonium compounds with acetanilide moieties of the type involved herein, or their preparation and advantageous use in the present invention. The present electrolysis is concerned with production of monomeric products, i.e. monomeric chloroacetanilides and other N-acyl anilides.

SUMMARY OF THE INVENTION

The present invention in one aspect involves the electrolytic reduction of [ortho(N-acylamino)phenylalkyl] sulfonium salts to obtain orthoalkyl-N-acylanilides. It also involves the preparation and use of [ortho(N-acylamino)phenylalkyl]sulfonium salts in such process, and such salts as new compositions, particularly 2'(2-chloroacetylamino)3'-trifluoromethylbenzyldimethyl sulfonium salts. It has been found that such sulfonium salts with acylaniline moieties are more readily prepared as relatively pure, stable materials than are the corresponding salts with a free aniline amino group, and consequently are advantageous for use in the present process.

It has further been found that there are various advantages in the utilization of the acylaniline type sulfonium salts in an electrolytic reduction, rather than sulfides, sulfoxides, or sulfones as described in the copending application referred to hereinabove. The invention is particularly concerned with electrolytic reduction of [2'(2-chloroacetylamino-)3'-(trifluoromethyl)-phenylalkyl]sulfonium salts, (which are new compositions) to produce 2'-alkyl-6'-(trifluoromethyl)-2-chloroacetanilides. It has been found that the desired chloroacetanilides can be obtained in high yield with little loss of the chloro substituent in the reduction.

It has further been found that the electrolytic process can be conducted efficiently in aqueous solution with cosolvents and that solid electrodes can effectively be used as cathodes. Mercury can also be used as a cathode. The sulfonium salts reactants used are soluble in water, while the anilide products are nearly insoluble, and continous processes with continuous separation of product are feasible. Halogenated hydrocarbon and similar solvents can be used to extract the product from the electrolysis medium. The sulfide cleavage product from the sulfonium salt can be readily separated from the electrolysis medium and the chloroacetanilide product and, when the sulfonium salt is a dimethyl sulfonium salt of an orthoalkyl-N-acylaniline, the resulting sulfide is dimethyl sulfide. Since dimethyl sulfide is useful in preparing a sulfilimine as one of the intermediates in the preparation of the desired sulfonium salts of orthomethyl-N-acylanilines, it can be separated and advantageously recycled to the sulfilimine preparation step. Another feature is that dimethyl sulfide can advantageously be removed during the electrolysis to prevent reaction with the sulfonium salt reactant.

DETAILED DISCLOSURE

The electrolysis reaction of the present invention is illustrated:

Reaction 1

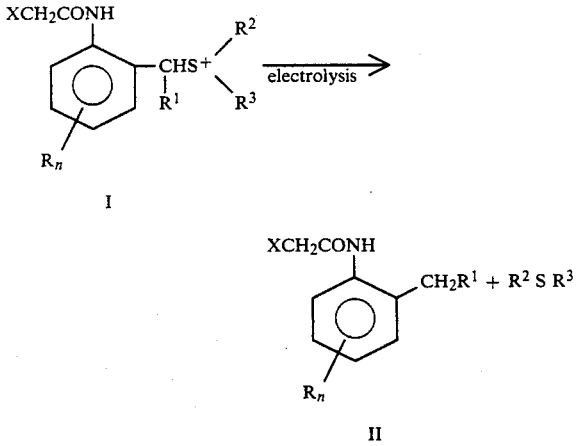

in which

R=alkyl, perfluoroalkyl, halogen or alkoxy n=0–4

$R^1$=alkyl or unsaturated alkyl $R^2$=alkyl or aryl $R^3$=alkyl or aryl

X=H, alkyl, aryl, chlorine or bromine

The illustrated cation I is accompanied by an anion, which can be designated as $A^-$, such as $CH_3OSO_3^-$, and can be produced by treatment of the corresponding sulfide compound, e.g. the orthomethylthiomethylanilide, with a dialkyl sulfate such as dimethyl sulfate.

Reaction 2

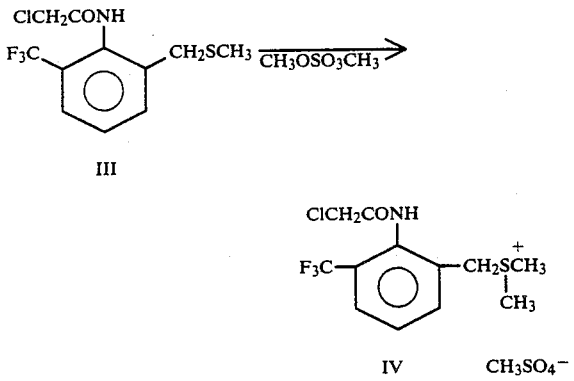

Compound IV is of particular interest for conversion to the corresponding ortho-methyl substituted chloroacetanilide as illustrated:

Reaction 3

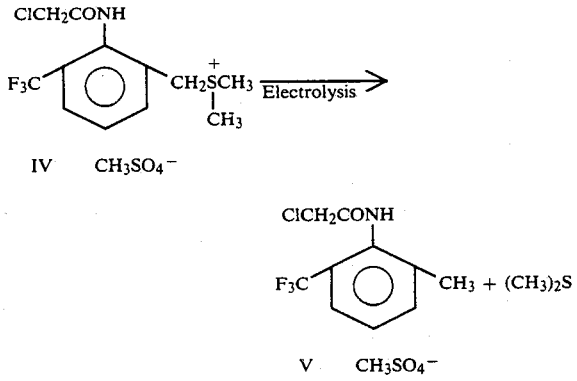

The compounds of type III can be obtained by chloroacetylation of the corresponding aniline, orthomethylthiomethyl,orthotrifluoromethyl aniline, VIII. ortho-Methylthiomethylanilines have been described in Jackson U.S. Pat. Nos. 3,996,371 and 4,006,183. The particular compound III can be prepared from orthoaminobenzotrifluoride by oxidative condensation with dialkyl sulfide, utilizing N-chlorosuccinimide as the oxidant. The resulting sulfilimine hydrochloride, when neutralized with a base, for example, triethylamine, may be thermally rearranged to obtain a compound such as VIII, particularly 2-methylthiomethyl-6-trifluoromethyl-aniline. The ortho-aminobenzotrifluoride is a known compound which can be prepared by the method of Reuben Jones, described in *Journal Amer. Chem. Soc.*, Vol. 69, page 2346 (1947).

The reactions to obtain a compound III, 2'-(methylthiomethyl)-6'-(trifluoromethyl)-2-chloroacetanilide, can be illustrated as follows:

Reaction 4

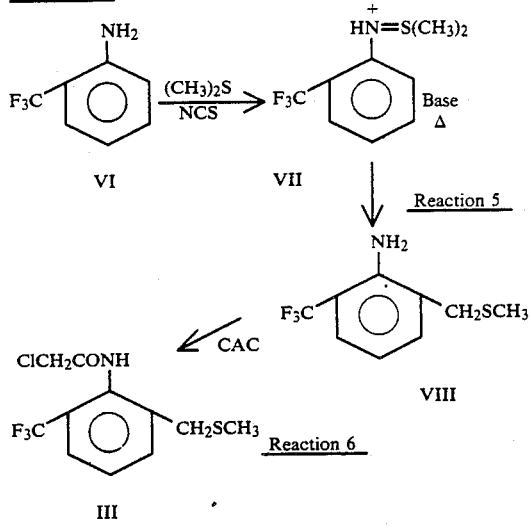

In the above reactions NCS stands for N-chlorosuccinimide and CAC stands for chloroacetylchloride.

It will be noted that a sulfide is formed as a cleavage product in the electrolysis process of the present invention, as illustrated in Reaction 1. above. When $R^2$ and $R^1$ are methyl, as in a dimethyl sulfonium salt, the cleavage product is dimethyl sulfide. Since dimethyl sulfide is used as a reactant in preparing one of the sulfilimine precursors for the sulfonium salt reactant of Reaction 1., as illustrated in Reaction 4, the dimethyl sulfide from Reaction 1. can be recycled to the sulfilimine preparation step illustrated in Reaction 4., thereby avoiding the need to provide additional sulfide reactant. The combination of the illustrated steps, with recycle, is further advantageous in that it avoids the need to find some alternate use or environmentally safe method of disposal for the sulfide cleavage product.

In the above illustrated reactions the reactants are generally shown with chloroacetyl groups on or being added to the amino group. However, various other acyl groups can be employed in the preparation of the various anilides and in their conversion to sulfonium salts, and electrolytic desulfurization to orthoalkyl anilides. For example, the various groups represented by X in compound I hereinabove can replace the chloro group in the chloroacetyl substituent of compounds III and IV, and in the 2'-methyl-6'-trifluoromethyl-2-chloroacetanilide V produced by electrolytic reduction of compound IV.

In the anilinosulfur compounds illustrated as compounds I and II herein, in Reaction 1, the alkyl and other groups employed as R, $R^1$, $R^2$ and $R^3$ substituents can vary over a broad range of number of carbon atoms, e.g. from 1 to 10 or so carbon atoms, but more often in the range of 1 to 6 or so carbon atoms, e.g. methyl, ethyl, isopropyl, butyl, sec-butyl, amyl, hexyl, etc., and similarly for alkoxy, methoxy, butyloxy, etc. Various perfluoroalkyl groups can be present, but groups such as trifluoromethyl, pentafluoroethyl, etc. are likely to be of most interest. Ordinarily, there will be only one of the illustrated R substituents on a position of the aniline ring, but it is possible to have such substituents on additional positions and still obtain the desired reaction.

The R groups on the ring can be the same or different. The trifluoromethyl group is of particular interest as a substituent, and methyl, ethyl, methoxy and ethoxy substituents may also be particularly suitable for use. Some compounds of interest have the R groups ortho to the amino group of the aniline, but the present process can be effected with an R substituent in the meta or para position.

The $R^1$ group on the carbon of the sulfur-bearing moiety is preferably hydrogen, but alkyl or unsaturated alkyl groups can be employed, such as ethyl, methyl, vinyl, or allyl. Some examples of reactants which can be employed in the electrolysis step of the present invention include 2'-(2-chloro-N-acetylamino)3'-trifluoromethylbenzyldimethylsulfonium salts, e.g., the methylsulfate salt,2-N-acetylamino-3-trifluoromethylbenzyldimethyl-sulfonium salts,2'(2-chloro-N-acetylamino)-3'-trifluoromethyl-methylbenzyldimethyl sulfonium methylsulfate,2-(N-propionyl-amino)-3-trifluoromethylbenzyldimethylsulfonium methylsulfate, 2'-(2-chloro-N-acetylamino)-3'-trifluoromethylbenzyldiethylsulfonium ethylsulfate, 2'-(2-chloro-N-acetylamino)-3'-methylbenzyldimethylsulfonium methylsulfate, 2'(2-chloro-N-acetylamino) 3'-methoxybenzyldimethylsulfonium chloride, 2'(2-chloro-N-acetylamino)3'-trifluoromethylbenzylmethylphenylsulfonium tosylate, 2'(2-chloro-N-acetylamino)4'trifluoromethylbenzyldimethylsulfonium methylsulfate.

In the process of the present invention the $R^2$ and $R^3$ groups in the illustrated reactants I and IV do not appear in the product and various organic radicals can be employed, so long as they do not cleave more readily than the substituted benzyl group in the reactant. However, the methyl group is a simple group for use, and the dimethylsulfonium salts can be conveniently prepared by reactions illustrated herein, making the methyl group the usual choice. However, reactants with various other $R^2$ and $R^3$ groups can be prepared and utilized if desired. While $R^1$, $R^2$ and $R^3$ will generally be hydrocarbyl, it will be recognized that non-interfering substituents can be present thereon, and that this is also true as to substituents elsewhere in the reaction.

The electrolysis process of the present invention involves reductive cleavage at the cathode of a sulfonium cation. As the reduction is occurring at the cation, any electrolytically acceptable anion can be employed in the illustrated electrolysis reaction, e.g. chloride, bromide, tosylate, fluoroborate, nitrate, sulfate, etc., and typical alkylating agents can be used to form such salts, e.g. methyl bromide, methyl tosylate, or diethyl sulfate can be substituted for the dimethyl sulfate in converting thiomethyl groups to sulfonium ions. The salts will be expected to have the desired water solubility and stability without concern as to the particular salt anion.

The above referred-to U.S. Pat. No. 4,404,069 teaches procedures for electrolytic desulfurization of ortho-aminobenzyl sulfides, sulfoxides and sulfones. However, the present process has certain advantages over such procedures in that the sulfonium cation tends to discharge at a less negative cathode potential and can be utilized with less tendency to reduction of trifluoromethyl or other sensitive substituents in the reactant molecule. The reduction of the sulfonium ion can be carried out effectively at solid electrodes and with use of fairly simple aqueous catholytes. The reduction of the sulfonium ion is a 2 Faraday per mol process without a propensity to co-reduction of the liberated sulfide. (In the case of use of the sulfoxide reactants, the liberated sulfenic acid is subject to further reduction.) Also, the sulfonium salts are suitable as conducting electrolytes, making it unnecessary to have other electrolytes in the electrolysis medium, although additional electrolytes can be employed if desired. A further advantage, particularly with respect to 2'-(2-chloroacetylamino)-3'-trifluoromethylbenzyldimethylsulfonium salts as used herein, is the fact that the sulfonium salts are very water soluble, while the desulfurized products are practically insoluble in water, providing for convenient continuous systems for separation of product. A further significant advantage is the fact that the liberated cleavage product is a diorgano sulfide, and dimethyl sulfide can be recovered and recycled to a process for preparing a sulfilimine precursor to the sulfonium salt reactant. This also obviates a disposal problem presented by mercaptan or other sulfur compounds which are produced in desulfurization processes with benzyl sulfides, etc.

One of the objects of the present invention is to provide a route for desulfurization of ortho-methylthiomethylorthotrifluoromethylanilines as represented by compound VIII in the reactions hereinabove. It happens that compound VIII itself is not readily amenable to conversion to a sulfonium salt, as reaction with an alkylating agent such as dimethyl sulfate leads to a mixture of products, apparently involving formation of polymeric materials because of reactions occurring at the free amino group of the aniline moiety. However, it has been discovered that if the amino group is acylated, the sulfonium salts can readily be formed and have advantageous solubility properties. Moreover, it is particularly advantageous to provide an N-chloroacetyl substituent, such as substituent is desirable for particular herbicides which can be produced from products of the presently claimed processes. Thus, in one aspect the present invention involves converting 2-amino-3-trifluoromelthylbenzyl sulfides to 2-acylamino-3-trifluoromethylbenzyldialkylsulfonium salts, and electrolytic desulfurization of such salts to obtain N-acyl-2-methyl-6-trifluoromethylanilides; and particularly the conversion of 2'(2-chloro-N-acetylamino)3'-trifluoromethylbenzyl methyl sulfides to 2'(2-chloro-N-acetylamino)-3'-trifluoromethylbenzyldimethylsulfonium methylsulfate and electrolytic desulfurization to N-chloroacetyl-2-methyl-6-trifluoromethylaniline. The stated conversions can be accomplished by reacting the described sulfides with an acid chloride, particularly chloroacetyl chloride for chloroacetylation, and then an alkylating agent such as dimethyl sulfate. The resulting sulfonium salt is then electrolyzed at the cathode to obtain an anilide with a methyl substituent in place of the sulfonium bearing moiety.

The electrolytic process in the present invention is useful for producing compounds which are useful as intermediates for the production of herbicidally effective chloroacetanilides. See commonly assigned Belgian Pat. No. 887,997 which describes 2-haloacetanilides which are particularly effective against perennial weeds such as quackgrass and nutsedge in various crops, particularly corn and soybeans with the acetanilides being particularly exemplified by N-(ethoxymethyl)-2'-methyl-6'-trifluoromethyl-2-chloroacetanilide. For example, 2-methyl-6-trifluoromethylaniline is converted to 2'methyl-6'-trifluoromethyl-2-chloroacetanilide which is then reacted with chloromethyl ethyl ether in methylene chloride, utilizing benzyl triethylammonium bromide as a phase transfer catalyst, to obtain N-(ethoxymethyl)-2'-methyl-6'-trifluoromethyl-2-chloroacetanilide. It will be noted that the present electrolytic process produces a chloroacetanilide, so the chloroacetylation step has already been performed, thus constituting a difference in the route, although the final herbicidal compounds may be the same. The chloroacetylation step must be performed at some stage in order to have a chloroacetanilide product. There is advantage to performing the chloroacetylation prior to producing a sulfonium salt, as described herein, in order to produce a more stable and easily recoverable sulfonium salt. Thus the present invention involves conversion to a sulfonium salt to make electrolytic desulfurization more facile, and also involves selection of an acylated aniline for the sulfonium salt in order to have a more stable and suitable sulfonium salt.

It is fortunate and surprising to find that the chloroacetyl group does not interfere in the electrolysis reaction and in general is unaffected and retained in the electrolysis product. The chloro substituent on the acetyl might have been expected to be reducible at the cathode or to take part in interfering reactions, but it has been found feasible under conditiones described herein to produce the desired chloroacetanilides with little loss of the chloro substituent. It happens that sulfide cleavage produces, such as dimethyl sulfide, can displace the chloride from the chloroacetanilide sulfonium salt to form a disulfonium salt, which upon electrolytic reduction yields an acetanilide product rather than a chloroacetanilide. The amount of the dechlorinated product was initially very small in some continuous procedures, but increased with reaction time. If allowed to go unchecked, the dechlorinated product in some procedures might be as high as 15% or so of product, representing a significant loss in yield. Fortunately, the nature of the loss was discovered and it was found that it could be controlled and minimized by running the electrolysis under conditions where the concentration of sulfide cleavage product was kept relatively small during the electrolysis. In theory this can be done by conducting the electrolysis to obtain only low conversions before product is separated. A more practical method is to conduct the electrolysis under conditions causing removal of the sulfide from the electrolysis medium. For example, a volatile sulfide such as dimethyl sulfide can be permitted to evaporate from the electrolysis medium, or can be removed by entrainment with nitrogen or other gas streams. Thus, a gas disengager can be installed in the flow stream between an electrolysis cell and an electrolyte reservoir. A simple disengager can be employed, such as a packed column with nitrogen flowing counter current to catholyte, and the nitrogen exiting through a cold-trap to remove condensable material.

The sulfonium salt reactants in the present electrolysis can be used in crude form, or can be purified by isolation as a solid prior to the electrolysis. The electrolysis can be carried out very effectively on the impure sulfonium salt with good conversion of and yield from the sulfonium salt present. However, the impurities which are present are carried through the process and still present in the product, and there is no convenient purification method for the electrolysis product. Therefore, it is advantageous to effect purification at the sulfonium salt stage, where the solid product separates from liquid media in relatively pure form, which can be further purified if desired, by extraction procedures which can involve simple washing of a product filter cake with extracting solvent. The purification is useful in removing impurities resulting from the sulfonium salt procedure, as well as those which may be present from preparations of various precursors enroute to the sulfonium salt. The sulfonium salt stage is a convenient stage to accomplish desired purification in order to provide an ultimate herbicidal product meeting content and performance specifications.

The present electrolysis process can be conducted in usual electrolysis solvents, and fortunately can be conducted very well in aqueous media. Water or water-containing solvents will generally be preferred, although other solvents, particularly polar solvents, can be used. It will generally be desirable to use solvents which dissolve or disperse substantial amounts of the sulfonium salt, such as water, acetic acid, acetonitrile, propionitrile, dioxane, dimethylformamide, etc., or lower alkanols, such as methanol, ethanol, propanol, butanol and the like. In order to limit electrode fouling it is advantageous to include a solvent with some solubilizing power for the anilide product produced by reduction of the sulfonium salt. In aqueous systems, it is advantageous to have methanol or acetonitrile as a cosolvent. For cosolvents it is desirable to use solvents which are miscible with, or which have substantial miscibility with the main solvent. It is possible to use two phase systems, but at solid electrodes this may cause increased production of a dechlorinated product when a chloroacetanilide is involved, or require high electrolysis cell voltages. Mixed aqueous solvents with a portion of cosolvents such as methanol or acetonitrile can conveniently be used, for example, with 10% to 60% by weight or more of the cosolvent, say about 25% by weight. Organic cosolvents can be used, generally with types and in ranges which are miscible with water. For continuous electrolysis systems, it will be advantageous to use cosolvents from which product can be separated conveniently, and which can be conveniently recovered and recycled. Methanol and acetonitrile are very suitable cosolvents.

With the desulfurized electrolysis product having very little solubility in water, the product can be very easily separated by extraction procedures with solvents for organic materials which do not have much solubility in water. For example, methylene chloride can be utilized as an extracting solvent, and is particularly advantageous for use when the electrolysis medium includes methanol as a cosolvent. Methanol forms an azeotrope with methylene chloride, and this makes it convenient to recycle methanol to a continous electrolysis process in which continuous product extraction with methylene chloride is employed. Thus a continuous electrolysis can be conducted in which an electrolysis medium with water, methanol and 2'(2-chloroacetylamino-)3'-(trifluoromethyl)benzyldimethylsulfonium methyl sulfate is circulated between a reservoir and the cathode compartment of an electrolysis cell. A side stream from the reservoir or cell is conducted to a packed extraction tower where it is subject to counter current extraction with a stream of methylene chloride. The catholyte from the tower is returned to the catholyte reservoir or the catholyte section of the electrolysis cell. The methylene chloride, containing product, is conducted from the extraction tower to a reboiler pot from which methylene chloride is distilled, condensed in a water-cooled condenser, and recycled to the methylene chloride inlet to the extraction tower. The product, which remains in the pot is periodically removed (without interrupting the extraction process), generally as about a 25–30% solution in methylene chloride. As methanol forms an azeotrope with methylene chloride, the methanol which has been extracted is substantially returned to the extacting tower. This provides methanol for dissolution by the methylene chloride in the extraction tower, so that there is little additional extraction of methanol from the catholyte and steady state conditions can be approached. Thus, methylene chloride extractant used in conjunction with an aqueous methanol electrolysis medium provides a very efficient and convenient product separation system. Methylene chloride extractant can also be used with an acetonitrile and water electrolysis medium, and the product separation is good. However, acetonitrile and methylene chloride do not form an azeotrope, so the acetonitrile recycle in a continuous process lacks the feature of use of the azeotrope for convenient recycle. However, acetonitrile does form an azeotrope with trichloroethylene, and the use of trichloroethylene extractant with an acetonitrile-water electrolysis medium is very advantageous.

As noted above, it is advantageous to use a cosolvent with water in order to lessen the tendency for product to deposit on the cathode. With a mercury cathode, there is generally no significant deterioration in the efficiency of the electrolysis process due to product deposition on the cathode. With solid cathodes, however, there are generally tendencies toward more or less of a decline in selectivity to desired product because of deposition on the cathode. In general, any of the generally useful electrode materials can be employed as cathode. Solid cathodes have some advantages over mercury in convenience for large scale operations. Generally, useful electrode materials which can be used include metals, alloys, graphite or other carbon electrodes, etc. known to the art. There may be advantage in using high hydrogen overvoltage materials such as mercury, zinc, lead, cadmium and the like, although this is not a very important consideration since the desired reaction does not require a very negative cathode potential, occurring around −1 volt vs. a saturated calomel electrode. Mercury, lead, lead amalgams, copper amalgams, cadmium and graphite are, for example, suitable cathode materials. In terms of current efficiency, selectivity, convenience and cost, graphite is usually preferred. The anode will not ordinarily have much influence on the reaction occurring at the cathode, so any of the useful anode materials can be used. For long term usage, it will be advisable to use anodes which are reasonably stable under the electrolysis conditions. Platinum or platinum plated materials can be used, and carbon and lead are also suitable. Also, the de Nora-type dimensionally stable anodes can be used, being anodes with precious metal oxides plated on a titanium substrate. Such anodes are available from the Diamond Shamrock Company, Cleveland, Ohio 44114.

Homogeneous solutions containing water and a cosolvent are fairly effective in providing electrolysis conditions for good results. The type and amount of cosolvent will be selected to obtain water miscibility and some product solubility, but avoiding miscibility of the electrolysis solution in the selected extracting solvent.

In general, the concentrations of the sulfonium salt reactant in the electrolysis medium do not greatly affect the efficiency of the electrolysis. Thus very dilute solutions can be used, on up to very concentrated solutions which may be more convenient for large scale production. For example, from less than 1% by weight up to 40 or more by weight, or even 50% or so if such amounts are soluble. Ordinarily, it will be desirable to avoid exceeding solubility limitations, although emulsions can be used if desired. Thus, a suitable range may be from less than 1% up to the solubility limit in the particular electrolysis medium.

Often it will be desirable to operate in the range of about 5% to about 20% by weight of the sulfonium salt, or with solutions which are approximately 0.1 to 0.5 molar in sulfonium salt.

In addition to the effects of a main cosolvent, it has been found that small amounts of additional solvents for organic materials, which have very limited water solubility, can have beneficial effects. When methylene chloride is used as an extracting solvent in continuous procedures, it has been found that the resulting small concentration of methylene chloride contributes to high selectivity to the desired product, i.e., 2′-methyl-6′-trifluoromethyl-2-chloroacetanilide. However, when a gas disengager was employed to remove dimethyl sulfide, it also removed methylene chloride, and tended to cause some cathode coating with hydrogen evolution and some loss in current efficiency. This suggests a possible advantage in more or better main cosolvent, supply of additional methylene chloride at appropriate location in the recycle, or possibly less rigorous removal of the dimethyl sulfide. Another approach is to use a less volatile extracting solvent, e.g. trichloroethylene, chloroform or dichloroethane. Such other extracting solvents can be used with, for example, catholytes of 25 to 50% aqueous methanol or aqueous acetonitrile. The use of trichloroethylene extractant with aqueous acetonitrile gave very good results, although some trichloroethylene was removed along with dimethyl sulfide by the gas disengager.

The present electrolytic process can be conducted in an undivided cell, or in a divided cell. While interfering reactions at the anode may be possible, it has nevertheless been found that good results can be obtained in an undivided cell. However, there are some advantages to use of a cell with appropriate membrane divider. It happens that the electrolysis ordinarily generates more proton at the anode than is used up at the cathode or in cathode promoted reactions. Thus to prevent overly acidic conditions which might inhibit the desired cathode reactions, it is advantageous to have a divided cell and to use an anion exchange membrane divider to avoid passage of proton, but to permit passage of anions. The methylsulfate anion is not used up in the electrolysis, and would accumulate in a continuous reaction. Thus, it is desirable to permit it to pass through the membrane to the anolyte, from where it can be purged for disposal. Since some proton is used in the electrolysis, catholyte pH would gradually increase in a continuous process if some proton were not provided. However, commercially available anion exchange membranes are sufficiently non-selective to leak some proton, and by control of anolyte pH the leakage rate may be regulated to maintain relatively constant catholyte pH. The anolyte can suitably be a dilute concentration of strong acid, as for example about 1% by weight sulfuric acid, which can be maintained in acid range comparable to about 1% to 5% by weight sulfuric acid, by continuous or periodic purge of the acid and replacement with water. The electrolysis can be operated over broad catholyte pH ranges without control of this parameter, but it is generally preferred to operate at pH ranges of about 0.5 to about 4, and usually circa pH 1.

In the electrolysis of the present invention, a broad range of current densities can be used to effect the process, such as from less than 5 milliamperes/$cm^2$ to over 100 milliamperes/$cm^2$, but operations will more commonly be in the range of about 20 or 30 to about 80 milliamperes/$cm^2$, or better, about 50 to about 80 milliamperes/$cm^2$. The lower parts of the ranges are effective, but there is advantage in using relatively high density to produce more rapid reaction and efficient use of equipment, if results are not adversely affected. Of course, the maximum densities for effective use are affected by mass transfer rates, catholyte circulation or stirring, reactant solubility, etc. which determine the amount of reactant available at the cathode surface for reaction. Fortunaterly the present reactants are very soluble in aqueous media. The current density can be regulated so as not to have current in excess of that needed to reduce the aniline sulfonium compound available at the cathode. This can be monitored by chromatography, ascertaining that all of the current is acounted for in terms of reaction, i.e. disappearance of the aniline sulfur reactant, for which theory in the present process is 2 Faradays/mole.

Good current efficiency can be obtained, but because of variations in flow rates, diffusion, etc. there will be instances where reactant is not available at particular points on the cathode, and other electrolysis reactions occur. However, it is generally possible to operate at current densities well removed from those that are excessive, so that very high or nearly quantitative current efficiencies are obtainable with respect to reactant disappearance.

The temperature at which the present electrolysis is conducted is not generally an important parameter, and ambient temperatures or lower, on up to about 100° C. or the boiling point of components can be used or higher if pressure is employed. The electrolysis will generate heat from electrical resistance, making it convenient to operate at somewhat elevated temperatures, and usually appropriate in large scale processes to provide for cooling, as by coils for cooling water in reservoirs. In some cases slightly elevated temperatures may be advantageous in promoting solubility. There is ordinarily no need for elevated temperatures, and in some electrolyses high temperatures may tend to promote chemical reactions at the expense of the desired electrolysis reaction.

A supporting electrolyte is not generally used in the present electrolytic process as the sulfonium ion itself serves as electrolyte. However, supporting electrolytes can be used if desired, being those which do not discharge under the electrolysis conditions. Since the cathode potential of the desired reaction is only around −1 volt (vs. saturated calomel electrode), it is feasible to use a variety of electrolyte salts, including those with sodium, potasium, etc. cations, as well as quaternary ammonium cations, or other cations with highly negative discharge potentials. The electrolyte can have various anions as the anionic component, such as halides, phosphates, sulfates, methylsulfates, etc.

As discussed hereinabove, the dimethylsulfide cleavage product produced in the present electrolysis can be utilized in the preparation of a sulfilimine precursor, as illustrated in Reaction 4 hereinabove. The preparation of ortho-(methylthiomethyl) anilines from the corresponding anilines via sulfilimine intermediates is known. Claus, Tetrahedron Letters, p. 3607 (1968), describes the preparation of aromatic sulfilimines from anilines and dimethylsulfoxide in the presence of $P_2O_5$ in a base such as triethylamine. Claus also discloses thermal rearrangement of these sulfilimines to ortho-(methylthiomethyl) anilines. See also, Gassman, Tetrahedron Letters, p. 497 (1972) and Johnson, Tetrahedron Letters, p. 501 (1972). Gassman discloses the use of N-t-butyl anilines to generate N-t-butyl-N-chloro anilines and subsequently sulfilimine salts with dimethyl sulfide which, upon treatment with a base under anhydrous conditions, were converted to ortho-(methylthiomethyl) anilines. Vilsmaier, Tetrahedron Letters, p. 625 (1972) describes the reaction of anilines with dimethyl sulfide and N-chlorosuccinimide to form sulfilimine hydrochloride salts. Vilsmaier does not teach the rearrangement of the sulfilimine salt. Another method of preparation of sulfilimine salts is disclosed in Claus and Vilsmaier, Tetrahedron Letters 31, p. 505 (1975). This article like the previous Vilsmaier article, discloses the reaction of anilines with dimethyl sulfide in the presence of N-chlorosuccinimide to form the sulfilimine hydrochloride salt. In Claus and Vilsmaier the sulfilamine hydrochloride salt is neutralized with aqueous caustic but Claus and Vilsmaier do not disclose the rearrangement of the sulfilimine produced by this process. See also Gassman U.S. Pat. Nos. 3,894,034, 3,954,797; 3,960,962; 3,985,765; and 4,034,375. The Gassman patents generally relate to the preparation and rearrangement of sulfilimine salts to produce ortho-methylthiomethyl anilines. The orthomethylthiomethyl anilines used in the prsent invention can be prepared using any of the sulfilimine preparation and rearrangement procedures described in the art. However, in order to have the advantage of using a dimethyl sulfide cleavage product of the electrolysis, it is necessary to use a process utilizing dimethyl sulfide as a reactant. In addition to prior art procedures, an improvement process is described and claimed in a commonly assigned application of one of the present applicants and another, Ser. No. 530,153, filed 9/7/83. In the improvement, the conversion of ortho-aminobenzotrifluoride to 2-(methyl-thiomethyl)-6-(trifluoromethyl)aniline is carried out in a single common solvent. In the process the steps comprise (a) reacting ortho-aminobenzotrifluoride with dimethylsulfide and N-chlorosuccinimide in an inert solvent, such as methylene chloride to produce N(2-trifluoromethylphenyl)-S-S-dimethyl sulfilimine hydrochloride and succinimide; (b) treating said sulfilimine hydrochloride with aqueous base, such as sodium hydroxide, to neutralize the hydrochloride to N-(2-trifluoromethylphenyl)-S,S-dimethyl-sulfilamine and to dissolve at least a major portion of the succinimide product in the aqueous phase as sodium succinimide, separating the phases, and subjecting the organic phase containing neutral sulfilimine to catalytic rearrangement in the presence of a minor amount of reaction product succinimide remaining in the organic phase, at moderate temperatures, to form 2(methylthiomethyl)-6-(trifluoromethyl)aniline. The sodium succinimide in the aqueous phase can be reacted with chlorine to produce N-chlorosuccinimide, which can be recycled for use as a reagent. The described improved process overcomes certain drawbacks and has certain advantages over the art, including avoiding a need for anhydrous conditions or a need for dry organic bases such as tertiary amines or high temperatures. While there are advantages in such improved process, the present invention can utilize general procedures for preparing orthomethylthiomethylanilines as part of a process to orthomethyl-N-acylanilides, such including reacting an aniline with dimethyl sulfide under conditions to produce the corresponding sulfilimine, and rearranging same with heat and/or basic conditions to the corresponding orthomethylthiomethylaniline; and reacting such aniline with an acyl chloride and an alkylating agent to obtain the corresponding orthoacylaminobenzyldimethylsulfonium salt, and electrolyzing such salt at the cathode to produce an orthomethyl-N-acylanilide and dimethyl sulfide; and recovering the dimethyl sulfide and utilizing it for further reaction with an aniline. Such general procedures can be used with such specific reactants as orthoaminobenzotrifluoride for its conversion to 2-(methylthiomethyl)-6-trifluoromethylaniline and thereafter by reaction, with acetyl chloride and an alkylating agent, such as dimethylsulfate, to 2'(2-chloro-N-acetylamino)-3'-trifluoromethyl-benzyldimethylsulfonium salt, followed by electrolysis to 2'-methyl-6'-trifluoromethyl-2-chloroacetanilide, also providing dimethyl sulfide for recycle.

In the overall process to prepare ortho methyl-N-acylanilines, the acylation step can be carried out by reacting ortho(methylthiomethyl) anilines with acyl halides. Conditions can be as described and claimed in commonly assigned copending application Ser. No. 530,136 of Arthur S. Clark, Jr., filed 9/7/83, which also claims certain of the acylated compounds, including 2'(methylthio-methyl)-6'-(trifluoromethyl)-2-chloroacetanilide. As described in that application, ortho(methylthiomethyl) aniline can be converted to a 2-haloacetanilide by reaction with a haloacetylhalide, e.g., chloroacetyl chloride. The reaction is carried out in an inert solvent, and a haloacetyl halide is combined with the aniline solution, preferably using a slight excess of the haloacetyl halide to ensure complete conversion. Alternatively, the aniline solution can be added to the haloacetyl halide. The reactants are usually slowly combined as a way of controlling the exothermic reaction that is present. After the reactants have been mixed, the reaction mixture is heated to promote the dissociation of the in situ generated anilinium salt. Reflux is preferably established at a reduced pressure for example when the reaction is in acetonitrile, preferably about 270 mm Hg., which corresponds to about 55° C. Hydrogen chloride released by dissociation and chloroacetylation reactions can be removed from the overhead by a caustic scrub. In general, the acylation reaction involves reaction of an acid halide, ordinarily an acid chloride, with the suitably substituted primary aniline, and conditions generally employed for such acylation reactions can be used although there are advantages in use of conditions as described in the aforesaid copending application.

The N-haloacylanilide which is obtained can be converted to a sulfonium salt by simple reaction with an alkylating agent, e.g., dimethyl sulfate. If desired, the reaction can be carried out in the same solvent as the haloacylation step, without isolating the N-haloacylaniline.

The following examples are illustrative of the invention.

EXAMPLE 1

A laboratory H-cell was used, which included two glass compartments secured together with a membrane divider. Openings at the top of the compartments permitted mounting electrodes or electrical connection to a mercury electrode. The cell was employed with a mercury cathode and platinum anode, and a cation exchange resin (NAFION 117) membrane. The catholyte was 30 ml of 0.2 Molar $KH_2PO_4$ (aqueous) and contained 1 gram of the sulfonium salt to be reacted, 2'(2-chloroacetylamino)3'(trifluoromethyl)benzyldimethylsulfonium methyl sulfate (2.36 millimoles). The anolyte was 30 ml of 5% by volume sulfuric acid (aqueous). Electrolysis was conducted at 100 milliamperes constant current to 350 coulombs, (cell voltage 7.2 volts), and then decreased to 50 milliamperes and continued to a total of 400 coulombs (cell voltage 5.4 volts). During electrolysis, a white solid formed, and monitoring by liquid chromatography shows a smooth decrease of the sulfonium reactant concentration. The catholyte was extracted three times with methylene chloride and the extracts were washed with water, dried over magnesium sulfate and separated from the sulfate by filtration. The methylene chloride was removed under reduced pressure to leave 460 mg. of white solid. Gas chromatographic analysis showed it to be 2'-methyl-6'(trifluoromethyl)-2-chloroacetanilide with a small amount of the corresponding dechlorinated acetanilide, 2-methyl-6-trifluoromethylacetanilide. Analysis by nuclear magnetic resonance indicated 85% of the desired chloroacetanilide and 15% of the corresponding acetanilide.

While the above example and other examples herein utilize a particular sulfonium salt for exemplification, it will be recognized that other sulfonium salts can be substituted in the examples and will produce corresponding anilides. For example, a sulfonium salt having a 2-acetylamino group in place of the 2'(2-chloroacetylamino) group can be utilized to produce a product differing from that in Example 1 in having a 2-acetylamino group, i.e. 2-acetylamino-3-trifluoromethylbenzyldimethylsulfonium methyl sulfate can be converted to 2-methyl-6-trifluoromethylacetanilide.

EXAMPLE 2

In this example a solid cathode was used with an aqueous electrolyte and an added, immiscible solvent. No supporting electrolyte was used. Also, an anion exchange membrane was employed. The cathode was lead and the anode was platinum. The catholyte was 30 ml water with 5 ml methylene chloride as a second phase. The catholyte contained 3 grams of the same sulfonium salt as Example 1, being that leading to preferred herbicidal intermediates. The anolyte was 5% sulfuric acid. Electrolysis was conducted at 100 milliamperes current. After 960 coulombs had passed, the catholyte pH was 1.4, and 10% NaOH in water was added to bring the pH to 6.3. Electrolysis was continued to a total of 1200 coulombs. Product was recovered by methylene chloride extraction as in Example 1, to obtain 1.17 grams of white solid. Analysis by nuclear magnetic resonance indicated 75% of 2'-methyl-6'(trifluoromethyl)2-chloroacetanilide and 25% of the dechlorinated acetanilide product. The overall current efficiency to the desired chloroacetanilide product was 60%.

EXAMPLE 3

In this example, an undivided cell was employed, being a cylindrical reactor with graphite cathode and graphite anode, each of about 5 $cm^2$ area. The electrolysis medium was a 30 weight percent acetonitrile in water solution and was 0.31 Molar in sulfonium salt, the sulfonium salt being the same as used in Example 1. Magnetic stirring was employed, and a slow purge with nitrogen was used to remove liberated dimethyl sulfide. A 200 milliampere constant current was passed for 2000 coulombs. Current efficiency as monitored by sulfonium disappearance was 82%. The acetonitrile was removed under reduced pressure and the aqueous residue was extracted with methylene chloride. The methylene chloride extracts were washed with water, dried over magnesium sulfate, and the methylene chloride removed under reduced pressure to give 1.85 grams of yellow solid. Analysis by Nuclear Magnetic Resonance indicated 95% 2'methyl-6'-trifluoromethyl-2-chloroacetanilide and 5% of the dechlorinated analog. The current efficiency to the desired product was 67%, and chemical yield, 82%.

EXAMPLE 4

This example describes the preparation of a chloroacetanilide and its conversion to a sulfonium salt. The reactor was a round bottomed flask equipped with thermometer, mechanical stirrer, reflux condenser with Dean Stark trap, and an additional funnel. A 442 gram amount (2.0 moles) of 2-methylthiomethyl-6-trifluoromethyl aniline was dissolved in 550 grams of acetonitrile in the flask. A slight vacuum was applied to the flask with the exit gases routed through 800 grams 10% aqueous NaOH. A dropwise addition of chloroacetylchloride was commenced, at a rate to raise and maintain reactor temperature to 55°±5° C., as a slurry develops. A total of 230.5 grams (2.04 moles) was added. The solution was clear after addition was completed. A 25 gram amount of acetonitrile was added to wash the addition funnel, and heating was commenced and pressure slowly reduced to produce a reflux at 55° C., which was then continued for ½ to 1 hour. The dimethyl sulfate, 289.9 grams (2.3 moles) was added fairly rapidly while still under reduced pressure and with the solution maintained. An additional 15 grams acetonitrile was added as additional funnel washings. The reaction was continued at atmospheric pressure for four hours, during which a slurry developed. Pressure was again reduced, and 315 grams acetonitrile was removed at reflux at 55° C. The resulting heavy slurry was allowed to cool to about 50° C. and 900 grams of methylene chloride was added as the slurry was cooled to room temperature. The slurry was then cooled to 15° C. and filtered. The filter cake was washed with 500 ml. of 20% by weight acetonitrile in methylene chloride, and dried overnight. The yield of sulfonium salt was 704.6 grams, 83.2% of theory. By liquid chromatographic assay the material was 99% 2'(2-chloroacetylamino)-3-trifluoromethylbenzyldimethylsulfonium methyl sulfate. The sulfonium salt can be used as reactant for electrolytic conversion to 2'-methyl-6'-trifluoromethyl-2-chloroacetanilide as described in other examples herein.

EXAMPLE 5

An electrolysis was carried out in a divided cell with graphite cathode and an anion exchange membrane divider (Ionics 103PZL389 anion exchange membrane). The electrolysis was run with a 25% methanol in water catholyte, 800 ml in volume, and with sulfonium salt at a 0.3 molar concentration. The initial sulfonium salt charge was 127 grams (92.5% assay). Additional sulfonium salt was added at approximately 20 grams per hour, as needed to maintain the 0.3M concentration. The sulfonium salt is that formed from ortho-trifluoromethyl,orthomethylthiomethyl-2-chloroacetanilide and dimethyl sulfate, i.e.2'(2-chloroacetylamino)-3'-(trifluoromethyl)benzyldimethylsulfonium methylsulfate. The flow cell had a 50 $cm^2$ effective area graphite cathode separated by the ion exchange membrane and a narrow gap from a dimensionally stable anode (Electrode Corporation, TIR-2000) and the catholyte and anolyte were circulated between the membrane and the cathode and anode respectively, being cycled from reservoirs by pumps. A slip stream from the catholyte reservoir was circulated through a packed-bed counter-current extraction column to remove product, employing methylene chloride as the extractant. The methylene chloride was distilled from a reboiler and the distillate recycled to the extraction column. The anolyte was 1% by weight $H_2SO_4$, 1000 ml, which was 50% purged and diluted with deionized water every four hours. The electrolysis was run for 33 hours, charging a total of 709 grams of 92–93% assay sulfonium salt, and taking the reaction to virtually complete conversion. During the run and without disconnecting the extraction column, the methylene chloride in the reboiler pot was removed and replaced with fresh methylene chloride. Product was isolated by stripping methylene chloride therefrom under reduced pressure (using both original and replacement methylene chloride portions in the reboiler.) The current efficiency for conversion of the sulfonium salt was 99.3% (corrected for assay), and selectivity to the 2'-methyl-6'-trifluoromethyl-2-chloroacetanilide was 92%. A 397 gram amount of the crude product was obtained and assay was 89.4 weight percent of desired product. The assay of dechlorinated analog, 2-methyl-6-trifluoromethylacetanilide was 0.7%. The chemical yield of the desired chloroacetanilide product was 92%.

EXAMPLE 6

For a larger scale electrolysis, a general purpose plate-and-frame electrolysis cell marketed by the Swedish National Development Company was employed and equipped with a graphite cathode and an oxygen evolving Dimensionally Stable Anode. The cathode area was 400 $cm^2$. The separator was an anion exchange membrane (Ionics 103PZL389). The cell frames were polyvinyl difluoride and mounted between stainless steel end-plates. The catholyte and anolyte reservoirs were 10-gallon polypropylene tanks connected to the cell by polypropylene rigid piping. A catholyte slip stream was taken from a circulating pump outlet through a valve and rotameter to the lower part of a packed-bed counter-current extraction column packed with glass raschig rings. The extraction column was connected with a reboiler pot for distillation and return of extracting solvent to the top of the extraction column. An electrolysis was conducted with a catholyte which was 25% acetonitrile in water and a 0.3 molar concentration of sulfonium salt reactant, 2'(2-chloroacetylamino)-3-(trifluoromethyl) benzyl-dimethylsulfonium methyl sulfate. The catholyte was 1% by volume sulfuric acid and the extracting solvent was trichloroethylene. The operating temperature was 30° C., with cooling being used as necessary to maintain this temperature. The catholyte and anolyte flow rates through the cell were 3 gallons per minute. The catholyte flow rate through the extraction column was 0.3 gallon per minute, and the trichloroethylene flow rate through the extractor was 20–25 ml/minute. Anolyte was purged at the rate of 20 ml/minute, with replacement by deionized water. The applied current was varied in 5-ampere steps during the electrolysis, from 15 to 25 amperes (37.5 to 62.5 milliamperes/cm$^2$). The electrolysis was run continuously for 48 hours with a total sulfonium salt reactant feed of 8.8 kilograms. The trichloroethylene in the reboiler pot was removed and replaced at times corresponding approximately to the changes in applied current and current density, providing four product extraction samples. The amount of dechlorinated by-product in the four samples was 0.95%, 2.08%, 3.13% and 3.36%, corresponding respectively to applied currents of 15, 20, 25 and 15 amperes. While there was some change in selectivity with current density, the last results at 15 amperes suggest other factors are involved. In this run, a gas disengager was utilized, and analysis of a cold trap on the disengager line showed dimethyl sulfide and also some acetonitrile, trichloroethylene, and traces of water. The concentration in the catholyte of a disulfonium salt derivative of the reactant increased during the electrolysis, but was lower than that in a prior run in which a gas disengager was not employed. The overall current selectivity to the desired 2-methyl-6-trifluoromethyl-2-chloroacetanilide was 91.4%, and to its dechlorinated analog, 2.2%. The mass balance was 93.6%.

EXAMPLE 7

This example describes a procedure for preparing N-(2-trifluoromethylphenyl)-S,S-dimethyl sulfilimine and converting it to 2-(methyl thiomethyl)-6-(trifluoromethyl)-aniline. N-chlorosuccinimide (40.7 g), methylene chloride (150 ml) and ortho-aminobenzotrifluoride (48.3 g) were added to a 500 ml flask. The reaction mixture was cooled to 0° C. amd 23 ml of dimethyl sulfide and admixture with 40 ml of methylene chloride was added. The temperature of the mixture was kept below 10° C. during addition. After adding all of the dimethyl sulfide, cooling was terminated and the reaction mixture was stirred an additional 20 minutes. 10% sodium hydroxide (0.246 mol) was then quickly added to neutralize the reaction mixture. An organic phase was then separated from an aqueous phase. The organic phase was concentrated using a vacuum rotary evaporator at ambient temperature condition. The organic residue was then triturated with hexane to give an insoluble solid which was filtered and air dried to give 62.5 g (94%) of colorless sulfilimine, melting point 97° to 98° C. Analysis calculated for $C_9H_{10}F_3NS$: C, 48.86; H, 4.56; S, 14.49; Found: C, 48.74; H. 4.60, S, 14.50. A sample of the sulfilimine (4.42 g) was slurried in 10 ml of heptane and heated at reflux. After 1 hour at reflux, nuclear magnetic resonance (NMR) spectroscopy indicated that less than 10% rearrangement had occurred. Succinimide (0.1 g) was added to the cooled reaction mixture and upon reheating to reflux, the sulfilimine was completely rearranged to 2(methylthiomethyl)-6-trifluoromethyl)aniline in less than about 10 minutes as verified by NMR spectroscopy.

What we claim is:

1. The process of producing orthoalkyl N-acylanilides which comprises electrolyzing an sulfonium salt at the cathode in an electrolysis medium at a cathode potential sufficiently negative and under conditions to effect reduction of the sulfonium salt and production of an ortho-alkyl-N-acylanilide.

2. The process of claim 1 in which an ortho-N-2-chloroacetylaminobenzylsulfonium salt is converted to an orthomethyl-2-chloroacetanilide.

3. The process of claim 1 in which an ortho(N-acylamino)-ortho-(trifluoromethyl)benzylsulfonium salt is converted to an orthoalkylorthotrifluoromethyl-N-acylanilide.

4. The process of claim 1 in which the reaction is represented:

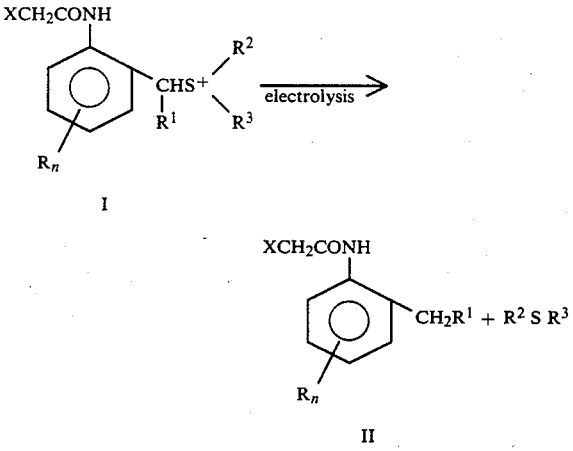

in which

R=alkyl, perfluoroalkyl, halogen or alkoxy n=0–4

$R^1$=alkyl or unsaturated alkyl $R^2$=alkyl or aryl $R^3$=alkyl or aryl

X=H, alkyl, aryl, chlorine or bromine.

5. The process of claim 1 in which the reaction is represented:

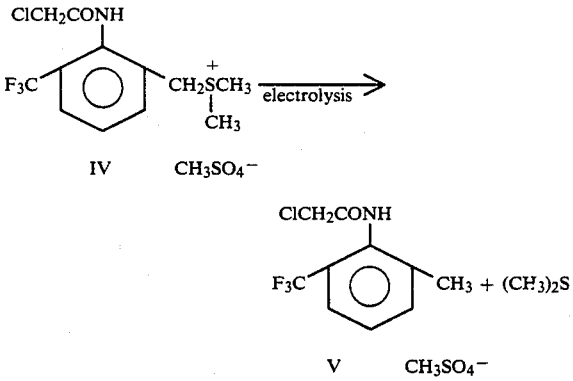

6. The process of claim 5 in which the electrolysis is conducted at a carbon cathode.

7. The process of claim 1 in which the electrolysis is conducted at a solid cathode.

8. The process of claim 1 in which the electrolysis is conducted in an aqueous electrolysis medium.

9. The process of claim 8 in which the aqueous electrolysis medium includes an organic solvent to increase product solubility and contribute toward selectivity to the desired product.

10. The process of claim 9 in which the solvent is miscible with water.

11. The process of claim 1 in which the process is conducted on a continuous basis in an aqueous electrolysis medium with charging of additional sulfonium salt reactant and extraction of product with an organic extracting solvent.

12. The process of claim 11 in which the reactant is a 2'(2-chloro-N-acetylamino)3'-trifluoromethylbenzyldimethylsulfonium salt and the process is conducted on a continuous basis with provision for substantial removal of dimethyl sulfide by-product in order to avoid its reaction with the reactant.

13. The process of claim 11 in which the electrolysis medium comprises water and acetonitrile.

14. The process of claim 13 in which trichloroethylene is employed as an extracting solvent to extract the product during the electrolysis.

15. The process of claim 14 in which the extracting solvent and acetonitrile are distilled from the product and recycled to the extraction on a continuous basis.

16. The process of claim 1 in which the electrolysis medium comprises methanol and water.

17. The process of claim 16 in which methylene chloride is employed as extracting solvent to extract the product during the electrolysis.

18. The process of claim 17 in which methylene chloride and methanol and distilled from the product and recycled to the extraction on a continuous basis.

19. The process of producing orthomethyl N-acylanilides which comprises reacting an aniline with dimethylsulfide under conditions to produce the corresponding sulfilimine compound and rearranging same under basic conditions to the corresponding orthomethylthiomethylaniline, and reacting such aniline with an acyl chloride and an alkylating agent to obtain the corresponding orthoacylaminobenzyldimethylsulfonium salt, electrolyzing such salt to produce an orthomethyl-N-acylanilide and dimethyl sulfide, and recovering the dimethyl sulfide and utilizing it for further reaction with an aniline to prepare a sulfilimine.

20. The process of claim 19 in which the aniline is ortho-aminobenzotrifluoride which is converted to 2-(methylthiomethyl)-6-trifluoromethylaniline, and subsequently to 2'(2-chloro-N-acetylamino)3'-trifluoromethyl-benzyldimethylsulfonium salt and 2'-methyl-6'-trifluoromethyl-2-chloroacetanilide.

21. The process of claim 19 in which the aniline is reacted with dimethylsulfide in the presence of N-chlorosuccinimide and a base is employed in the rearrangement of the resulting sulfilimine to a methylthiomethyl aniline.

* * * * *